US007685981B2

(12) United States Patent
Matsushima et al.

(10) Patent No.: US 7,685,981 B2
(45) Date of Patent: Mar. 30, 2010

(54) METHOD OF CONTROLLING VARIABLE VALVE TIMING SYSTEM, CONTROLLER, AND MOTORCYCLE INCLUDING CONTROLLER

(75) Inventors: Hirohide Matsushima, Kobe (JP); Yoji Fukami, Kakogawa (JP); Takeshi Ikeda, Akashi (JP); Kozo Suzuki, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 460 days.

(21) Appl. No.: 11/731,783

(22) Filed: Mar. 29, 2007

(65) Prior Publication Data

US 2008/0011254 A1 Jan. 17, 2008

(30) Foreign Application Priority Data

Apr. 3, 2006 (JP) ..... 2006-101974

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,431,131 B1 * 8/2002 Hosoya et al. ..... 123/90.15

FOREIGN PATENT DOCUMENTS

| | | | |
|---|---|---|---|
| JP | 05272361 A | * | 10/1993 |
| JP | 11-02140 | | 1/1999 |
| JP | 11-132016 | | 5/1999 |
| JP | 11-280430 | | 10/1999 |
| JP | 11-324629 | | 11/1999 |
| JP | 2002-242616 | | 8/2002 |
| JP | 3616734 | | 11/2004 |

OTHER PUBLICATIONS

Abstract of JP 05272361 A, Oct. 1993.*

* cited by examiner

*Primary Examiner*—Zelalem Eshete
(74) *Attorney, Agent, or Firm*—Alleman Hall McCoy Russell & Tuttle LLP

(57) ABSTRACT

A method of controlling a variable valve timing system comprising calculating, by a sliding mode control, a first control amount based on a deviation between a target value and an actually measured value of the position of the displacing member of the variable valve timing system, calculating a second control amount by integrating the deviation as an input when the deviation falls within a predetermined numeric value range containing a zero value, or by integrating the zero value as the input when the deviation falls outside the predetermined numeric value range; and adding the first control amount and the second control amount to set a compensation control amount for compensating the position of the displacing member.

17 Claims, 8 Drawing Sheets

METHOD OF CONTROLLING VARIABLE VALVE TIMING SYSTEM, CONTROLLER, AND MOTORCYCLE INCLUDING CONTROLLER

TECHNICAL FIELD

The present invention relates to a method of controlling a variable valve timing system configured to change a rotational phase of a camshaft with respect to a crankshaft, a controller, and a motorcycle comprising the controller.

BACKGROUND ART

For example, an engine mounted in a motorcycle is configured in such a manner that a crankshaft and a camshaft are rotatable in association with each other via a rotation transmission mechanism such as a chain and sprockets, and an intake valve and an exhaust valve are driven to be opened and closed at specified timings by a cam mounted to the camshaft. To be specific, the cam has a unique profile, and causes each valve to be opened and closed by predetermined opening and closing degrees at specified opening and closing timings, according to the profile. When the intake valve is opened, an air-fuel mixture is suctioned into a combustion chamber of the engine. The air-fuel mixture is compressed by a piston, and is thereafter ignited at a specified timing to be combusted. The resulting combustion gas is expanded to push the piston back, causing the crankshaft to rotate. When the exhaust valve is opened, the combustion gas is exhausted from the combustion chamber.

Desired opening and closing timings of the valves vary according to an engine speed of the engine. For example, during an idling state, it is desirable to lessen a time period (overlap time) when the intake valve and the exhaust valve are both opened in order to stabilize combustion, while during a high-speed rotation state, it is desirable to retard a timing when the intake valve is closed to increase charging efficiency of intake air to gain a high output power.

As should be appreciated from the above, it is necessary to open and close the valves at timings according to the engine speed of the engine in order to suitably run the engine. As a conventional engine mounted in four-wheel automobiles to achieve the above purpose, an engine equipped with a hydraulic variable valve timing system is disclosed in, for example, Japanese Laid-Open Patent Application Publication Nos. Hei. 11-132016, 11-280430, 11-324629 and 2002-242616. The hydraulic variable valve timing system disclosed here includes a cam pulley which has an inner space and is rotatable in association with a crankshaft and a rotor which is accommodated in the inner space and mounted to an end portion of the camshaft. The inner space of the cam pulley is partitioned into an advanced angle space and a retarded angle space by the rotor. To which of these spaces a hydraulic oil is to be fed is controlled by an oil control valve operable in response to a command from a controller. By a pressure of the hydraulic oil fed, a rotational phase of the rotor with respect to the cam pulley is changed, thus controlling the opening and closing timings of the valves.

The controller is typically configured to calculate an operation amount of the oil control valve by proportional-integral control (PI control) using the engine speed and to output a command signal to drive the oil control valve based on a calculation result. The configuration is disclosed in, for example, Japanese Laid-Open Patent Application Publication No. Hei. 11-2140. Also, Japanese Patent Publication No. 3616734 discloses a so-called sliding mode control intended for the hydraulic control system.

However, in the hydraulic variable valve timing system subjected to the PI control, overshooting is likely to occur. In contrast, in a hydraulic variable valve timing system subjected to proportional control, due to a viscosity change of the hydraulic oil which may occur with a temperature change, mechanical manufacturing errors of the variable valve timing system or the oil control valve, etc., a deviation will result from the event that a position of the rotor has converged before reaching a target value. Therefore, it is desirable to control a gain based on temperature of the hydraulic oil to execute general proportional control, integral control, differential control, and a combination of these. But, it is not easy to control the gain correctly.

SUMMARY OF THE INVENTION

Accordingly, an object of the present invention is to provide a method of controlling a variable valve timing system, a controller, and a motorcycle comprising the controller, which are capable of suppressing occurrence of overshooting or of reducing a deviation with a relatively easy method and configuration regardless of viscosity change of a hydraulic oil or a mechanical manufacturing error.

The present invention has been made under these circumstances, and a method of controlling a variable valve timing system configured to change a position of a displacing member to change a rotational phase of a camshaft with respect to a crankshaft, according to the present invention, comprising calculating, by a sliding mode control, a first control amount based on a deviation between a target value and an actually measured value of the position of the displacing member of the variable valve timing system; calculating a second control amount by integrating the deviation as an input when the deviation falls within a predetermined numeric value range containing a zero value, or by integrating the zero value as the input when the deviation falls outside the predetermined numeric value range; and adding the first control amount and the second control amount to set a compensation control amount for compensating the position of the displacing member.

In this configuration, the operation of the variable valve timing system can be suitably controlled so as to suppress occurrence of overshooting or to reduce a deviation with a relatively easy method. To be specific, primary advantages of high responsiveness to change of the target value of the position of the displacing member and suppressing of occurrence of overshooting can be achieved by the sliding mode control. In addition to this, the deviation can be reduced by the integral control. Furthermore, since the integration operation is executed only when a deviation between the target value and a current value falls within a predetermined numeric value range containing a zero value, i.e., only when the deviation has a relatively small value, suitable control is accomplished without degrading the advantage of the sliding mode control that occurrence of overshooting is suppressed while reducing the deviation.

A controller for a variable valve timing system according to the present invention comprises a deviation calculator configured to calculate a deviation between a target value and an actually measured value of the position of the displacing member of the variable valve timing system; a deviation range determiner configured to determine whether or not the deviation falls within a predetermined numeric value range containing a zero value; a sliding mode control calculator configured to, by a sliding mode control, calculate a first control amount based on the deviation; an integral control calculator configured to calculate a second control amount by integrating an output from the deviation range determiner; and an adder configured to add the first control amount and the second control amount to set a compensation control amount for compensating the position of the displacing member; wherein the deviation range determiner is configured to output the deviation to the integral control calculator when it is determined that the deviation falls within the numeric value range, and to output the zero value to the integral control calculator when it is determined that the deviation falls outside the numeric value range.

Thereby, with a relatively simple configuration, the operation of the variable valve timing system can be controlled so as to suppress the occurrence of overshooting, reduce the deviation, and achieve high responsiveness as described above.

In the controller, the numeric value range associated with the deviation which is used for determination in the deviation range determiner may have an upper limit value of not more than plus 5 degrees and a lower limit value of not less than minus 5 degrees.

Thereby, a suitable second control amount is gained in the integral control calculator, and the advantage of the sliding mode control that overshooting is suppressed can be maintained while reducing the deviation.

A motorcycle of the present invention comprises the above described controller for the variable valve timing system.

Thereby, with a relatively simple configuration as described above, the variable valve timing system can be controlled so as to suppress occurrence of overshooting, reduce the deviation, and achieve high responsiveness so that running ability of the engine can be improved.

A motorcycle of the present invention comprises a controller for a variable valve timing system configured to change a position of a displacing member to change a rotational phase of a camshaft with respect to a crankshaft, the controller including a deviation calculator configured to calculate a deviation between a target value and an actually measured value of the position of the displacing member of the variable valve timing system; a deviation range determiner configured to determine whether or not the deviation falls within a predetermined numeric value range containing a zero value; a sliding mode control calculator configured to, by a sliding mode control, calculate a first control amount based on the deviation; an integral control calculator configured to calculate a second control amount by integrating an output from the deviation range determiner; and an adder configured to add the first control amount and the second control amount to set a compensation control amount for compensating the position of the displacing member; wherein the deviation range determiner is configured to output the deviation to the integral control calculator when it is determined that the deviation falls within the numeric value range, and to output the zero value to the integral control calculator when it is determined that the deviation falls outside the numeric value range.

The numeric value range associated with the deviation which is used for determination in the deviation range determiner may have an upper limit value of not more than plus 5 degrees and a lower limit value of not less than a minus 5 degrees.

The above and further objects, features and advantages of the invention will more fully be apparent from the following detailed description with accompanying drawings.

DETAILED DESCRIPTION OF THE PREFERRED EMBODIMENTS

Figure 1:
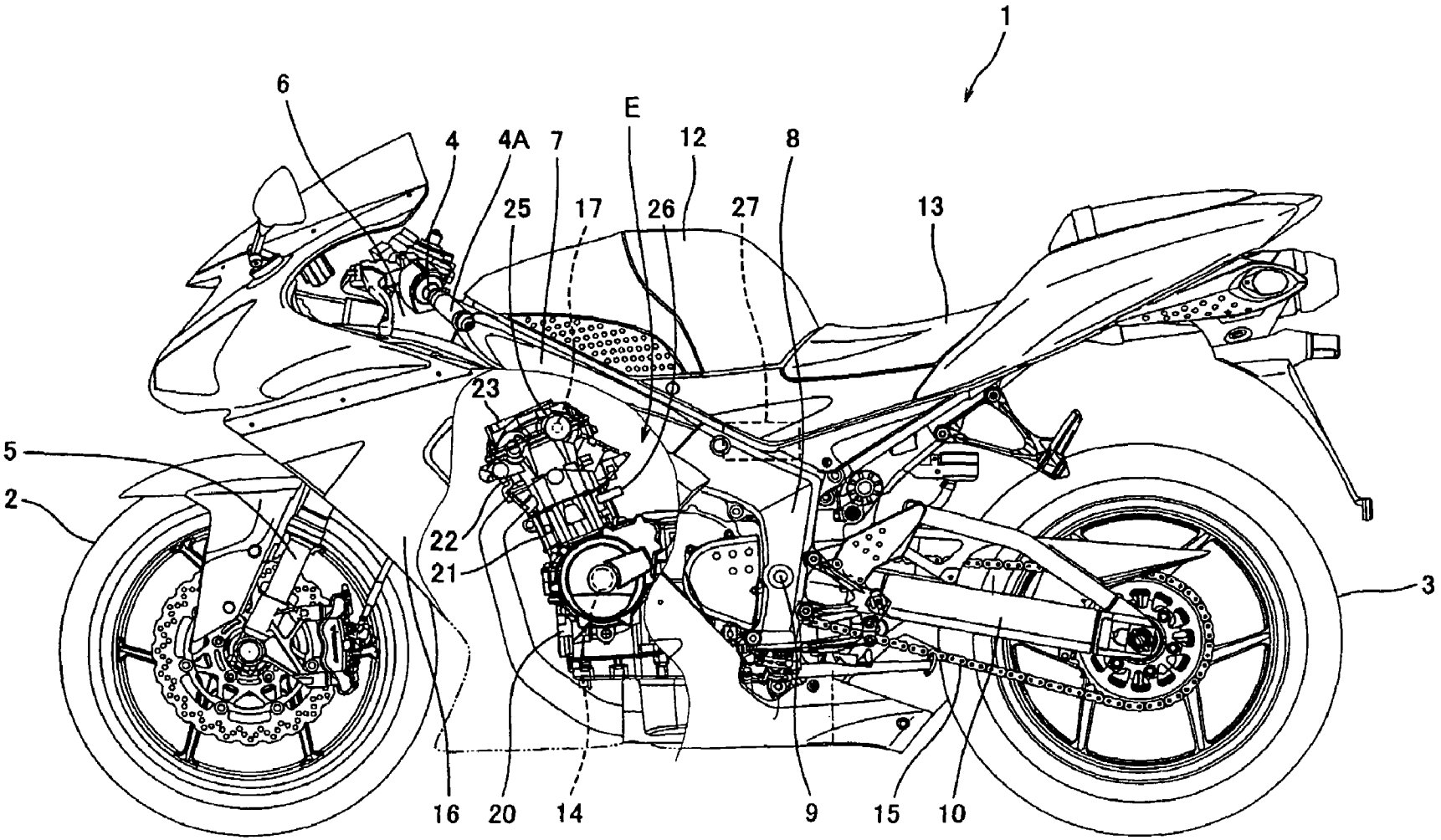
FIG. 1 is a left side view of a motorcycle of a road sport type comprising an engine equipped with a variable valve timing system according to an embodiment of the present invention.

Now, a method of controlling a variable valve timing system, a controller, and a motorcycle comprising the controller, according to an embodiment of the present invention will be described with reference to the accompanying drawings. FIG. 1 is a left side view of a motorcycle of a road sport type comprising an engine E equipped with a variable valve timing system according to an embodiment of the present invention. As used herein, the term "direction" refers to directions from the perspective of a rider (not shown) straddling a motorcycle 1 of FIG. 1, except for a case specifically illustrated.

Turning now to FIG. 1, the motorcycle 1 includes a front wheel 2 and a rear wheel 3. The front wheel 2 is rotatably mounted to a lower end portion of a front fork 5 extending substantially vertically. The front fork 5 is mounted to a steering shaft (not shown) by an upper bracket (not shown) provided at an upper end portion thereof and an under bracket (not shown) provided under the upper bracket. The steering shaft is rotatably supported by a head pipe 6. A bar-type steering handle 4 extending in a lateral direction is attached to the upper bracket. When the rider rotates the steering handle 4 clockwise or counterclockwise, the front wheel 2 is turned to a desired direction around the steering shaft which is a rotational shaft.

A pair of right and left main frame members 7 (only left main frame member 7 is illustrated in FIG. 1) forming a vehicle body frame extend rearward from the head pipe 6. Pivot frame members (swing arm brackets) 8 extend downward from rear regions of the main frame members 7. A swing arm 10 is pivotally mounted at a front end portion thereof to a pivot 9 attached on each pivot frame member 8. The rear wheel 3 is rotatably mounted to a rear end portion of the swing arm 10.

A fuel tank 12 is disposed above the main frame members 7 and behind the steering handle 4. A straddle-type seat 13 is disposed behind the fuel tank 12. An engine E is mounted between and under the right and left main frame members 7. The engine E is a four-cylinder four-cycle engine, and is constructed in such a manner that a crankshaft 14 extends in the lateral direction of the vehicle body. An output of the engine E is transmitted, through a chain 15, to the rear wheel 3, which thereby rotates. In this manner, the motorcycle 1 obtains a driving force.

A cowling 16 which is a unitarily formed member, is provided to cover a front portion of the motorcycle 1, to be precise, an upper portion of the front fork 5 and side portions of the engine E. The rider straddles the seat 13 to mount the motorcycle 1, holds grips 4A provided at end portions of the steering handle 4, and puts feet on steps (not shown) provided in the vicinity of a rear portion of the engine E to ride the motorcycle 1.

The engine E includes, in the following order from below, a crankcase 20 for accommodating the crankshaft 14, a cylinder block 21 for accommodating a piston which is not shown, a cylinder head 22 forming a combustion chamber together with the cylinder block 21, a cylinder head cover 23 for accommodating a camshaft 17 between the cylinder head cover 23 and the cylinder head 22. A chain which is not shown is installed around the crankshaft 14 and the camshaft 17, so that the camshaft 17 is rotatable in association with the crankshaft 14.

A hydraulic variable valve timing system 25 which is described later in detail is mounted to an end portion on an intake side of the camshaft 17 and is configured to operate based on an oil pressure of a hydraulic oil fed through an oil control valve 26 provided at a rear side wall portion of the cylinder block 21 of the engine E. A controller 27 is disposed below the seat 13 to control an operation of the engine E. The oil control valve 26 controls the oil pressure of the hydraulic oil to be fed to the variable valve timing system 25 based on a command from the controller 27.

Figure 2:
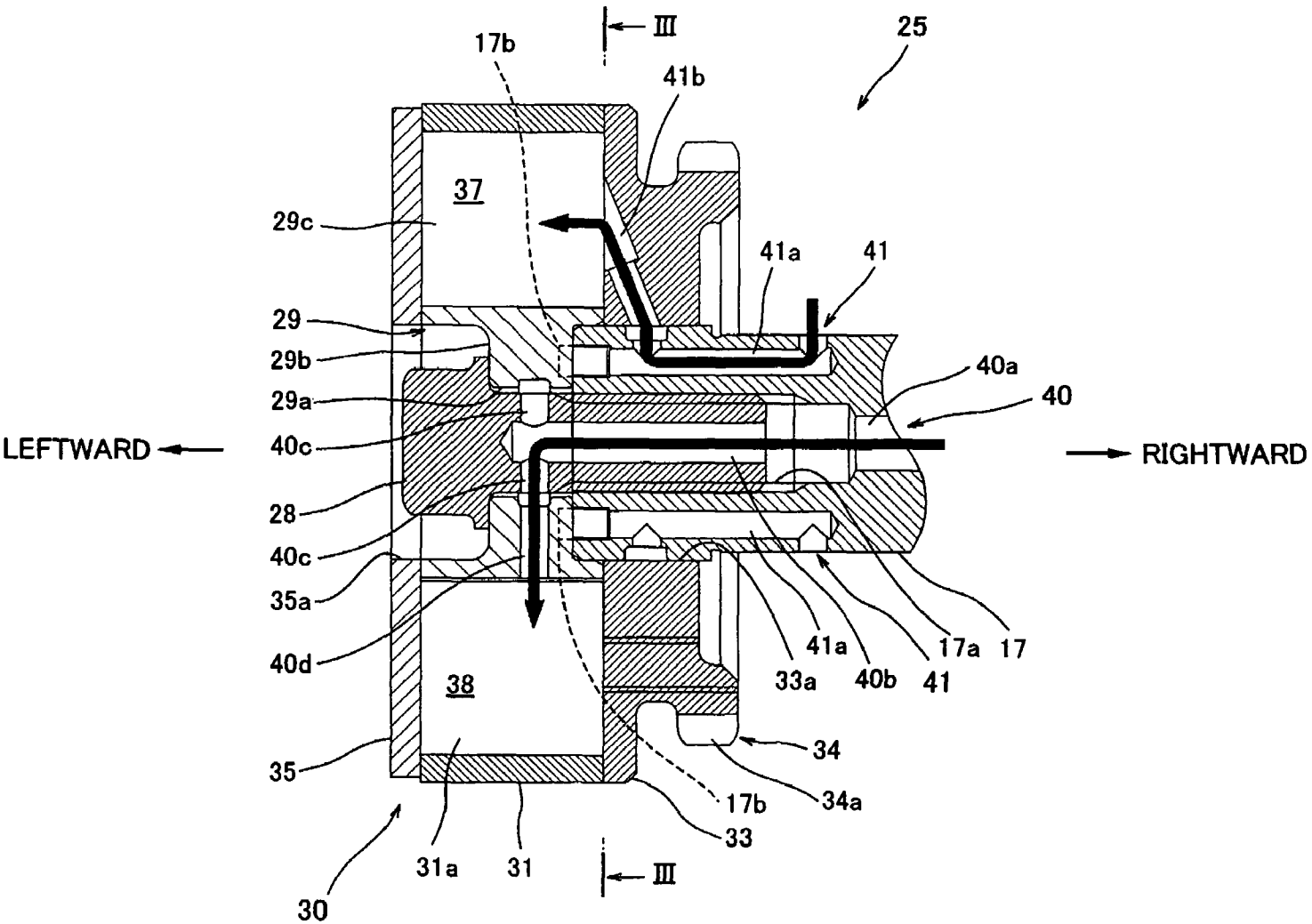
FIG. 2 is a cross-sectional view of the variable valve timing system which is formed by sectioning it along a plane extending in a center axis of a camshaft.
Figure 3:
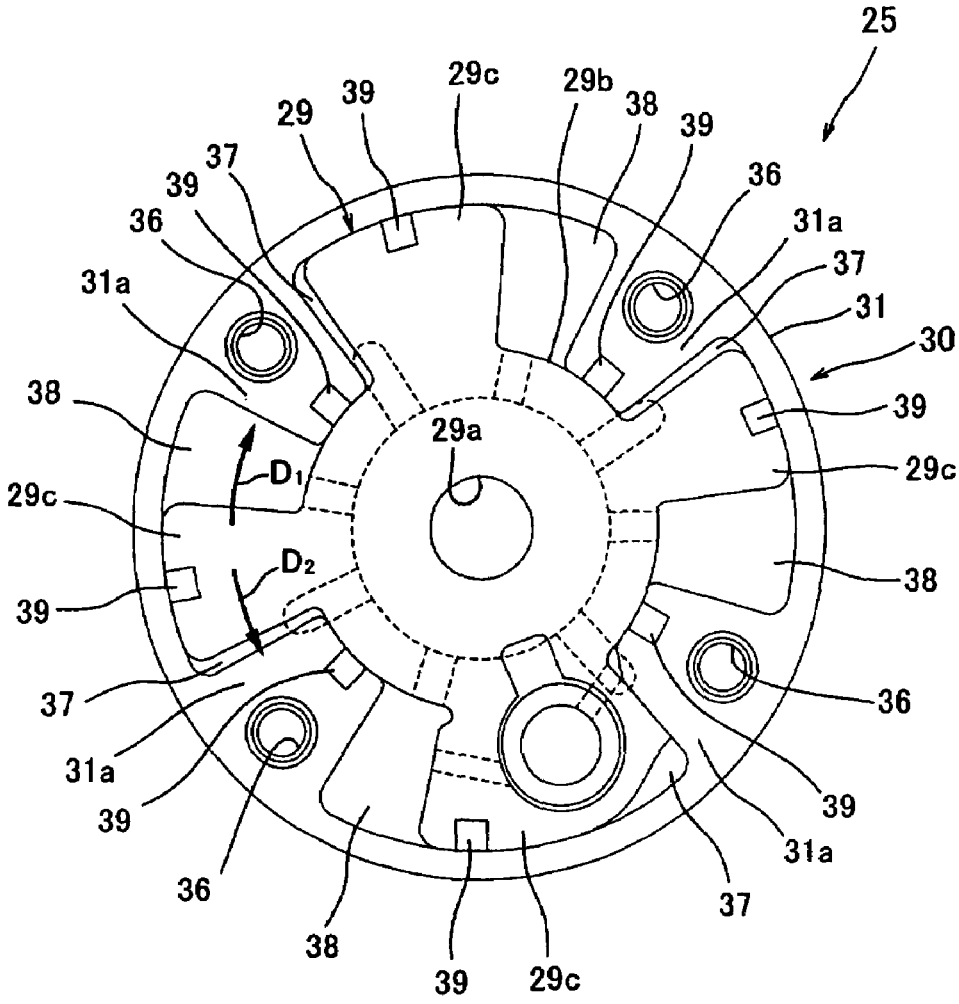
FIG. 3 is a view of the variable valve timing system, taken in the direction of arrows along line III-III of FIG. 2.

FIG. 2 is a cross-sectional view of the variable valve timing system 25 which is formed by sectioning it along a plane extending in a center axis of the camshaft 17. FIG. 3 is a view of the variable valve timing system 25, taken in the direction of arrows along line III-III of FIG. 2. As shown in FIG. 2, the variable valve timing system 25 includes a rotor 29 fastened to one end portion of the camshaft 17 by a center bolt 28 and a casing (displacement portion) 30 for accommodating the rotor 29.

As shown in FIG. 2, the rotor 29 includes a base portion 29*b* (see FIG. 3) fastened coaxially to the camshaft 17 by threading a center bolt 28 inserted into a hole 29*a* formed at a center region thereof into a bolt hole 17*a* formed at an end portion of the camshaft 17, and four vanes 29*c* (see FIG. 3) extending radially outward from the base portion 29*b*. The vanes 29*c* are arranged to be substantially equally spaced apart from each other along a circumferential direction of the base portion 29*b*. The casing 30 includes a cylindrical tubular member 31, a first lid member 33 and a second lid member 35 for closing openings at both ends of the cylindrical tubular member 31. As shown in FIG. 3, the tubular member 31 has four separating portions 31*a* protruding inward toward a center axis thereof from an inner wall surface thereof, and the separating wall portions 31*a* are arranged to be substantially equally spaced apart from each other. The rotor 29 and the tubular member 31 have a substantially equal length in a center axis direction (rightward and leftward direction in FIG. 2). The rotor 29 is accommodated in the tubular member 31 in such a manner that the vanes 29*c* and the separating wall portions 31*a* of the tubular member 31 are arranged alternately in the circumferential direction.

As shown in FIG. 2, the first lid member 33 of a circular plate shape is attached to the tubular member 31 on the camshaft 17 side (right side of FIG. 2) to close a right opening of the tubular member 31. The first lid member 33 is provided with a hole 33*a* at a center region thereof. The first lid member 33 is externally fitted to the camshaft 17 inserted into the hole 33*a*. A plurality of teeth 34*a* are arranged on an outer peripheral portion of the first lid member 33 in a circumferential direction thereof to form a cam sprocket 34 on the intake side. The cam sprocket 34 is configured to be coaxial with the camshaft 17, and the rotation of the crankshaft 14 (see FIG. 1) is transmitted to the cam sprocket 34 via the chain which is not shown. The second lid member 35 of a circular plate shape is attached to a left side of the tubular member 31 to close a left opening of the tubular member 31. A hole 35a is formed at a center region of the second lid member 35 to allow the center bolt 28 to be inserted thereinto.

In the above variable valve timing system 25, first, the first lid member 33 is externally fitted to one end portion of the camshaft 17, and the rotor 29 is threadedly engaged with the end portion of the camshaft 17 by the center bolt 28. The rotor 29 threadedly engaged with the camshaft 17 is positioned around a center axis by knock pins 17*b* attached to protrude from an end surface of the camshaft 17. The camshaft 17 and the rotor 29 are integrally rotatable. Then, the tubular member 31 is disposed to contain the rotor 29, and the second lid member 35 is attached to close the left opening of the tubular member 31. Then, the first lid member 33 and the second lid member 35, and the tubular member 31 sandwiched between them are fastened to one another by bolts (not shown) inserted into bolt holes 36 (only the bolt holes 36 formed on the separating wall portion 31*a* are illustrated in FIG. 3), assembling the variable valve timing system 25. The casing 30 formed in a unitary component is rotatable in association with the crankshaft 14 as described above, and is rotatable relative to the rotor 29 within a predetermined range in the rotational direction.

As shown in FIG. 3, in the variable valve timing system 25 assembled as described above, four advanced angle spaces 37 and four retarded angle spaces 38 are arranged alternately in regions formed between the vanes 29*c* of the rotor 29 and the separating wall portions 31*a* of the casing 30. Seal members 39 are provided at regions of the vanes 29*c* which are in slidable contact with an inner peripheral surface of the casing 30 and at regions of the separating wall portions 31*a* which are in slidable contact with an outer peripheral surface of the base portion 29*b* of the rotor 29. Therefore, each advanced angle space 37 and each retarded angle space 38 are sealed each other at the slidable contact regions of the rotor 29 and of the casing 30.

The variable valve timing system 25 is provided with passages through which the hydraulic oil is fed to the advanced angle spaces 37 and to the retarded angle spaces 38. To be specific, as shown in FIG. 2, an oil passage 40*a* is formed to extend along a center axis of the camshaft 17, and is connected to the bolt hole 17*a* into which the center bolt 28 is threaded. An oil passage 40*b* is formed to extend along a center axis of the center bolt 28 to open at a tip end portion (right end portion of FIG. 2) of the center bolt 28. The oil passage 40*b* is connected to the oil passage 40*a*. An oil passage 40*c* is formed in the vicinity of a head portion of the center bolt 28 to penetrate radially. The oil passage 40*c* is connected to the oil passage 40*b*. An oil passage 40*d* is formed to extend radially through the base portion 29*b* of the rotor 29 in such a manner that one end thereof is connected to the oil passage 40*c* and an opposite end thereof is connected to each retarded angle space 38. The oil passages 40*a* to 40*d* form a retarded angle oil passage 40. A hydraulic oil is fed from the oil control valve 26 described later (see FIG. 4) to the retarded angle spaces 38 through the retarded oil passage 40.

A plurality of oil passages 41*a* (two in FIG. 2) are formed at an end portion of the camshaft 17 in positions apart from the center axis. Each oil passage 41*a* extends radially inward from an outer peripheral surface of the camshaft 17, is bent in a predetermined position apart from the center axis to extend toward the end surface of the camshaft 17, and is further bent to extend radially outward to the outer peripheral surface of the camshaft 17. Therefore, each oil passage 41*a* has a plurality of (two in FIG. 2) openings on the outer peripheral surface of the camshaft 17. A passage portion of the oil passage 41*a* which extends along the center axis of the camshaft 17 is formed by drilling a hole from the direction of the end surface of the camshaft 17. An opening formed on the end surface of the camshaft 17 is closed by the knock pin 17*b* for positioning the rotor 29. An oil passage 41*b* is formed on the first lid member 33 provided with the cam sprocket 34 such that one end thereof is connected to the opening of the oil passage 41*a* on the end portion side of the camshaft 17 and an opposite end thereof is connected to the advanced angle space 37. The oil passages 41*a* and 41*b* form an advanced angle oil passage 41. The hydraulic oil is fed from the oil control valve 26 (see FIG. 4) described later to the advanced angle space 37 through the advanced angle oil passage 41.

Figure 4:
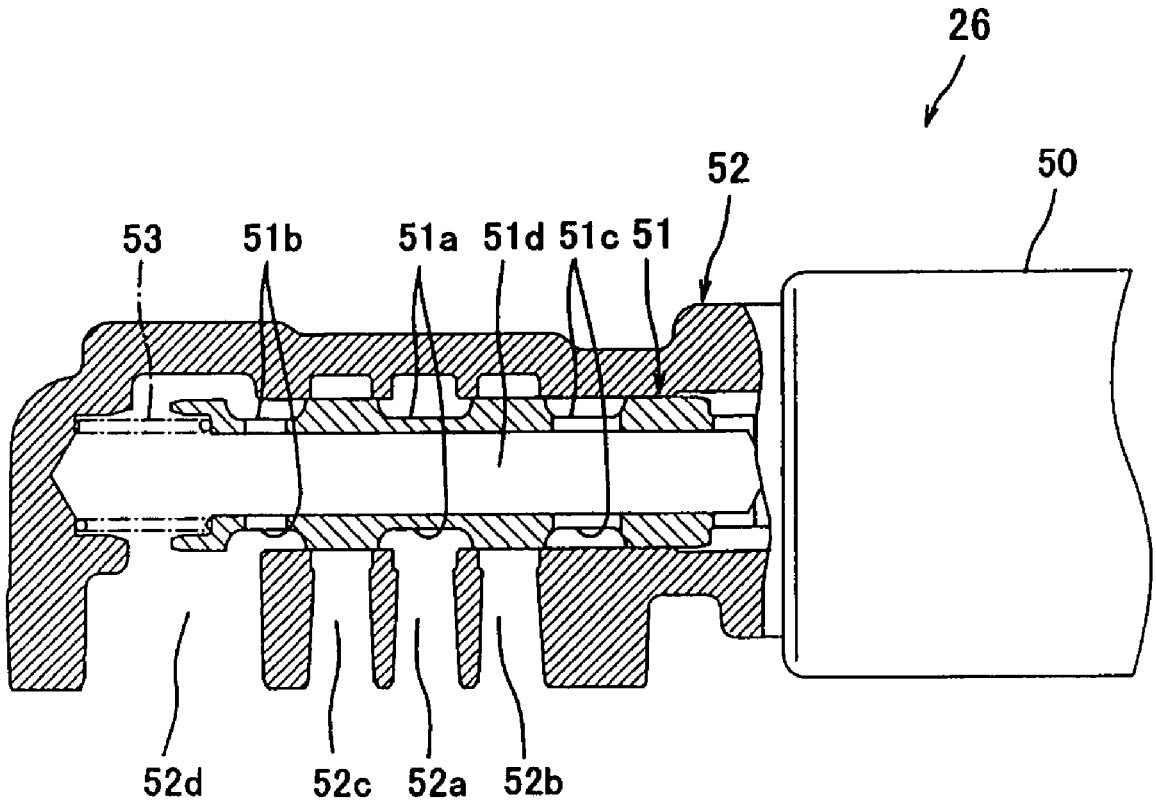
FIG. 4 is a partial cross-sectional view showing a structure of an oil control valve.
Figure 5A:
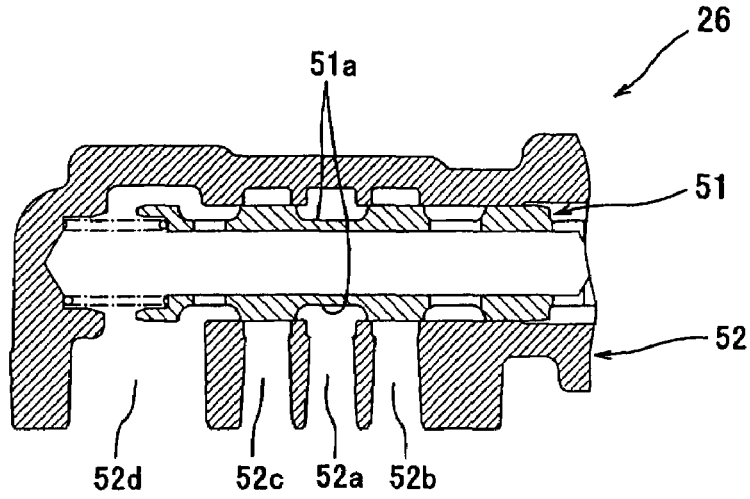
FIGS. 5(*a*), 5(*b*), and 5(*c*) are views showing an operation of the oil control valve of FIG. 4, in which FIG. 5(*a*) shows the oil control valve in a neutral position, FIG. 5(*b*) shows the oil control valve in a state where a hydraulic oil is fed to an advanced angle port, and FIG. 5(*c*) shows the oil control valve in a state where the hydraulic oil is fed to a retarded angle port.
Figure 5B:
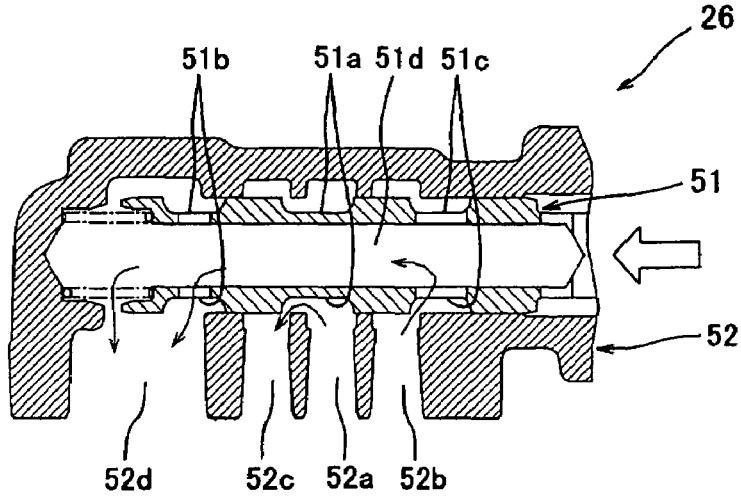
Figure 5C:
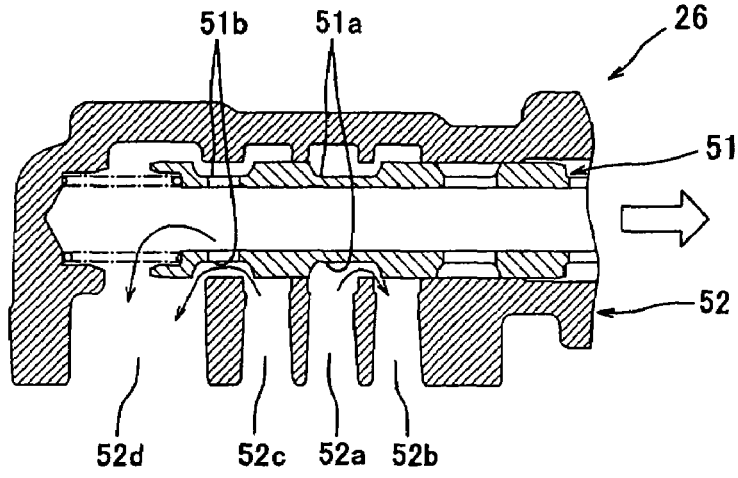

FIG. 4 is a partial cross-sectional view showing a structure of the oil control valve 26. FIGS. 5(*a*), 5(*b*), and 5(*c*) are views showing an operation of the oil control valve 26 of FIG. 4. As shown in FIG. 4, the oil control valve 26 includes as major components, an electromagnetic solenoid 50 composed of a coil and a plunger which are not shown, a spool 51 coupled at one end thereof to the plunger, and a housing 52 for accommodating the spool 51.

The spool 51 is of a substantially pipe shape. A groove 5 la with a small depth is formed at a substantially center region in a longitudinal direction of the spool 51 to extend in a circumferential direction thereof. A hole 51*b* and a hole 51*c* are formed on a tip end portion side and a base end portion side, respectively, relative to the groove 51 a and are connected to an inner space 51*d* of the spool 51. With the spool 51 accommodated in the housing 52, a tip end portion thereof is pressed toward the base end portion by a force applied by a coil spring 53 accommodated in the housing 52. The electromagnetic solenoid 50 causes the spool 51 to be displaceable in the longitudinal direction in accordance with a command from the controller 27 (see FIG. 1).

The housing 52 has a feed port 52*a*, a retarded angle port 52*b*, an advanced angle port 52*c* and a drain port 52*d* on a wall portion thereof. The ports 52*a* to 52*d* are connected to an inner space of the housing 52. The feed port 52*a* introduces, into the housing 52, via a flow meter and an oil filter which are not shown, the hydraulic oil which is stored in an inner bottom portion of the crankcase 20 (see FIG. 1) and is fed with a pressure by an oil pump (not shown). The hydraulic oil introduced from the feed port 52*a* is delivered to the retarded angle port 52*b* or to the advanced angle port 52*c* depending on a position of the spool 51.

The retarded angle port 52*b* and the advanced angle port 52*c* are connected to the retarded angle oil passage 40 and the advanced angle oil passage 41 (see FIG. 2) of the variable valve timing system 25, respectively, through a passage formed in a wall portion of the engine E, or a passage formed of a pipe and the like disposed outside the wall portion of the engine E. The drain port 52*d* is connected to the inner space 51 d of the spool 51 through the hole 51*b* of the spool 51.

The operation of the oil control valve 26 will be described with reference to FIGS. 5(*a*), 5(*b*), and 5(*c*). FIG. 5(*a*) shows the oil control valve 26 in a neutral position, FIG. 5(*b*) shows the oil control valve 26 in a state where the hydraulic oil is fed to the advanced angle port 52*c*, and FIG. 5(*c*) shows the oil control valve 26 in a state where the hydraulic oil is fed to the retarded angle port 52*b*.

In the neutral position shown in FIG. 5(*a*), the groove 51*a* formed at the center region of the spool 51 is connected only to the feed port 52*a* and is not connected to the retarded angle port 52*b* and to the retarded angle port 52*c*. Therefore, at this time, the hydraulic oil introduced from the feed port 52*a* into the inner space of the housing 52 is not fed to the retarded angle port 52*b* and to the advanced angle port 52*c*. In addition, in the neutral position, the retarded angle port 52*b* and the advanced angle port 52*c* are closed by an outer wall portion of the spool 51 and are not connected to the drain port 52*d*. Therefore, the hydraulic oil is not discharged from the retarded angle space 38 and the advanced angle space 37 of the variable valve timing system 25, maintaining a relative phase between the rotor 29 and the casing 30.

As shown in FIG. 5(*b*), when the controller 27 causes the electromagnetic solenoid 50 to displace the spool 51 toward the tip end (leftward in FIG. 5), the groove 51 a formed at the center region of the spool 51 is allowed to be connected to the feed port 52*a* and to the advanced angle port 52*c*. Thereby, the hydraulic oil introduced from the feed port 52*a* is fed from the advanced angle port 52*c* to the advanced angle space 37 of the variable valve timing system 25 through the advanced oil passage 41 (see FIG. 2). The retarded angle port 52*b* is allowed to be connected to the hole 51*c* of the spool 51, so that the hydraulic oil flows from the retarded angle space 38 of the variable valve timing system 25 through the retarded angle oil passage 40 and the retarded angle port 52*b* and further to the hole 51*b* at the tip end side through the hole 51*c* on the base end side of the spool 51 and the inner space 51d, and thereafter is discharged from the drain port 52*d*. As a result, the rotor 29 moves in a direction (toward advanced angle) indicated by an arrow D1 of FIG. 3, relative to the casing 30.

As shown in FIG. 5(*c*), when the electromagnetic solenoid 50 causes the spool 51 to be displaced toward the base end (rightward in FIG. 5), the groove 51 a formed at the center region of the spool 51 is allowed to be connected to the feed port 52*a* and to the retarded angle port 52*b*. Thereby, the hydraulic oil introduced from the feed port 52*a* is fed to the retarded angle space 38 of the variable valve timing system 25 through the retarded angle port 52*b* and the retarded angle oil passage 40 (see FIG. 2). The advanced angle port 52*c* is allowed to be connected to the drain port 52*d* through a gap formed in the vicinity of the hole 51 b on the tip end side of the spool 51 between the spool 51 and the housing 52, so that the hydraulic oil flows from the advanced angle space 37 of the variable valve timing system 25 through the advanced angle oil passage 41 and the advanced angle port 52*c* and is discharged from the drain port 52*d*. As a result, the rotor 29 moves in a direction (toward the retarded angle) indicated by an arrow D2 of FIG. 3, relative to the casing 30.

When the rotor 29 is thus displaced in the direction as indicated by the arrow D1 or D2 (see FIG. 3) to a desired position, the oil control valve 26 is caused to be in the neutral position according to the command from the controller 27, maintaining the phase of the rotor 29 with respect to the casing 30.

The controller 27 according to this embodiment of the present invention determines a compensation control amount (operation amount of the oil control valve 26) for compensating the position of the rotor 29 so that a rotational phase difference (actually measured value) between the crankshaft 14 and the camshaft 17 which is obtained based on a signal from a crank angle sensor suitably attached to detect a rotational phase of the crankshaft 14 and a signal from a cam angle sensor suitably attached to detect a rotational phase of the cam shaft (displacing member) 17 matches a target rotational phase difference (target value) determined from the engine speed of the engine E. Hereinafter, a configuration of the controller 27 and a control method executed by the controller 27 will be described.

Figure 6:
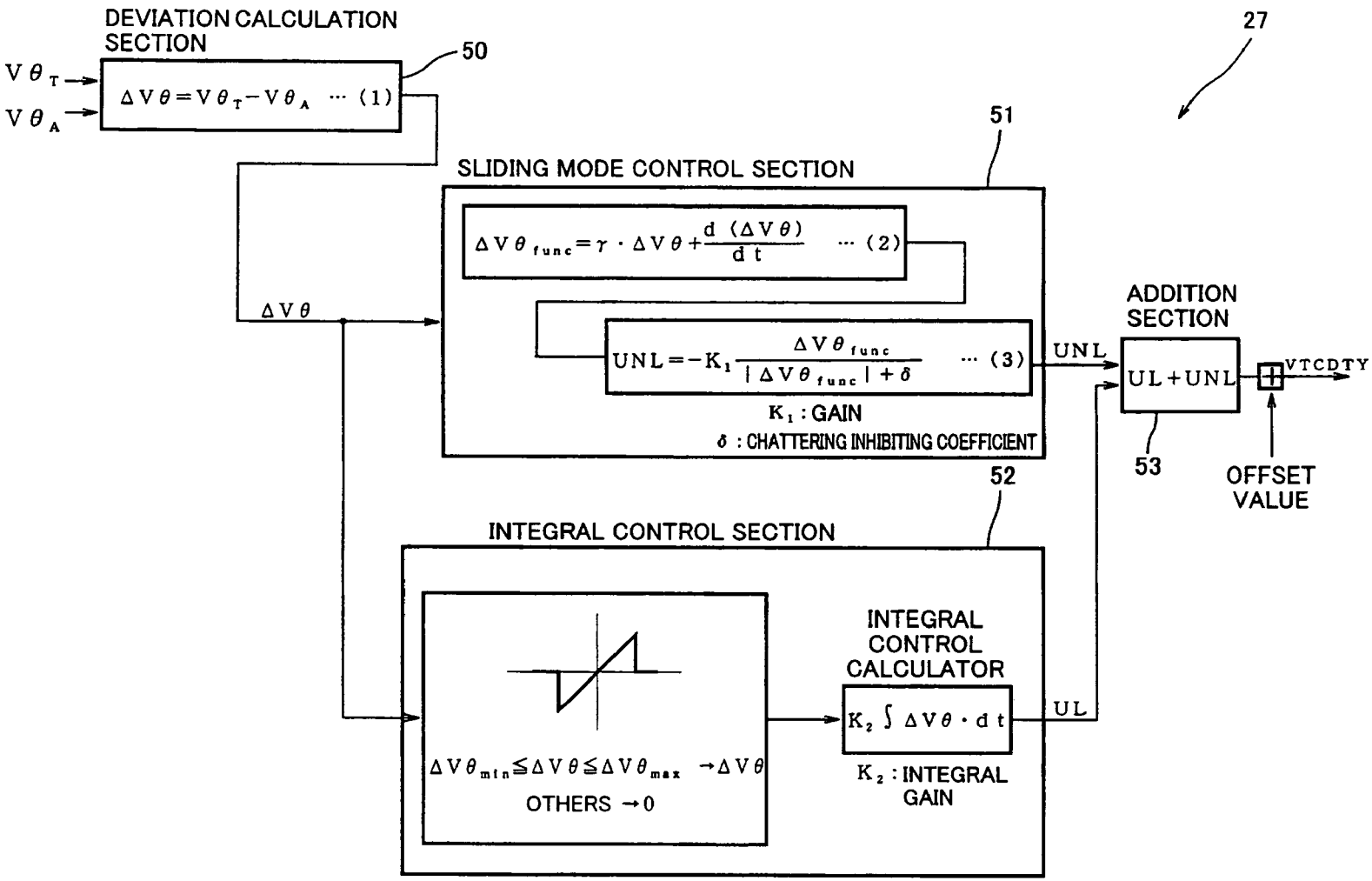
FIG. 6 is a control block diagram showing a configuration of a controller.
Figure 7:
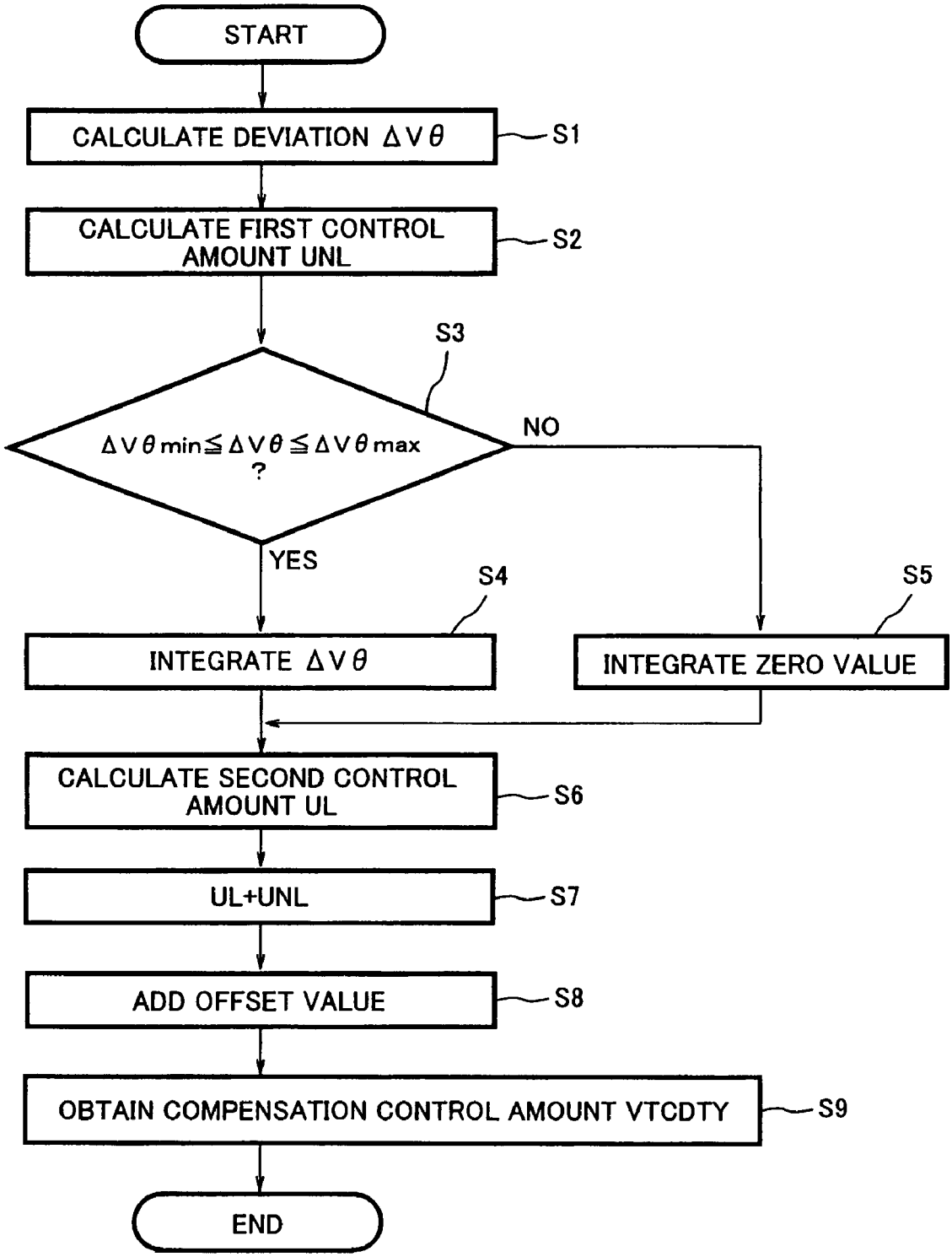
FIG. 7 is a flowchart showing a flow of calculation of a compensation control amount which is executed by the controller of FIG. 6.

FIG. 6 is a control block diagram showing the configuration of the controller 27. FIG. 7 is a flowchart showing a flow of calculation of a compensation control amount which is executed by the controller 27. As shown in FIG. 6, the controller 27 is configured to execute a sliding mode control and a conditional integral control and to calculate a final compensation control amount from control amounts (first control amount, second control amount) respectively obtained from these controls.

To be more specific, the controller 27 has a deviation calculation section (deviation calculator) 50 configured to calculate a deviation Δ V θ (e.g., 5 degrees) between a target value V θ T (e.g., 30 degrees) and an actually measured value V θ A (e.g., 25 degrees) of the rotational phase according to a calculation formula (1) shown in FIG. 6 (step S1 in FIG. 7). The deviation Δ V θ is input to a sliding mode control section (sliding mode control calculator) 51 and to an integral control section (integral control calculator) 52.

The sliding mode control section 51 calculates a switching function Δ V θ func by adding a value obtained by multiplying the deviation Δ V θ by a slope (gain) γ to a value obtained by differentiating the deviation Δ V θ by time (formula (2) in FIG. 6). The switching function Δ V θ func is applied to a smoothing function to inhibit chattering to obtain a first control amount UNL which is an output of the section 51 (formula (3) in FIG. 6, S2 in FIG. 7).

In the integral control section 52, a first section (deviation range determiner) determines whether or not the deviation Δ V θ falls within a predetermined numeric value range containing a zero value (S3 in FIG. 7). To be specific, the controller 27 of this embodiment determines whether or not the deviation Δ V θ falls within a predetermined range Δ V θ range which is not less than a lower limit value Δ V θ min=−5 degrees and not more than an upper limit value Δ V θ max=+5 degrees. If it is determined that the deviation Δ V θ falls within the range Δ V θ range (S3: YES in FIG. 7), the deviation Δ V θ is integrated by a specified integral gain K2 (S4 in FIG. 7) to obtain a second control amount UL which is an output of the section 52 (S6 in FIG. 7). On the other hand, if the deviation Δ V θ falls outside the range Δ V θ range (S3: NO in FIG. 7), the integral control section 52 integrates the zero value (S5 in FIG. 7) to obtain the second control amount UL (S6 in FIG. 7). Since the integral control section 52 holds a value obtained by previous integration, the second control amount UL obtained by integrating the zero value in step S5 has a value equal to that obtained by the previous integration.

Then, the first control amount UNL and the second control amount UL are input to an addition section (adder) 53, which adds these (S7 in FIG. 7), and further adds a predetermined offset value (S8 in FIG. 7) to obtain a compensation control amount VTCDTY (S9 in FIG. 7). As used herein, in this embodiment, the offset value refers to a value for setting the oil control value 26 in a substantially neutral position, for example, a value of 50% in a case where its movable range is 0% to 100%. The offset value thus set is used to set the spool 51 in the neutral position shown in FIG. 5(*a*). A sum of the first control amount UNL and the second control amount UL "UNL+UL" to which the specified offset value is added indicates a compensation amount from the neutral position.

As described above, the controller 27 obtains the compensation control amount VTCDTY based on the first control amount UNL calculated in the sliding mode control section 51 and the second control amount UL obtained in the integral control section 52. The oil control valve 26 is driven according to the compensation amount VTCDTY, so that the rotor 29 of the variable valve timing system 25 is phase-controlled with respect to the casing 30, to be precise, the camshaft 17 is phase-controlled with respect to the crankshaft 14.

Figure 8:
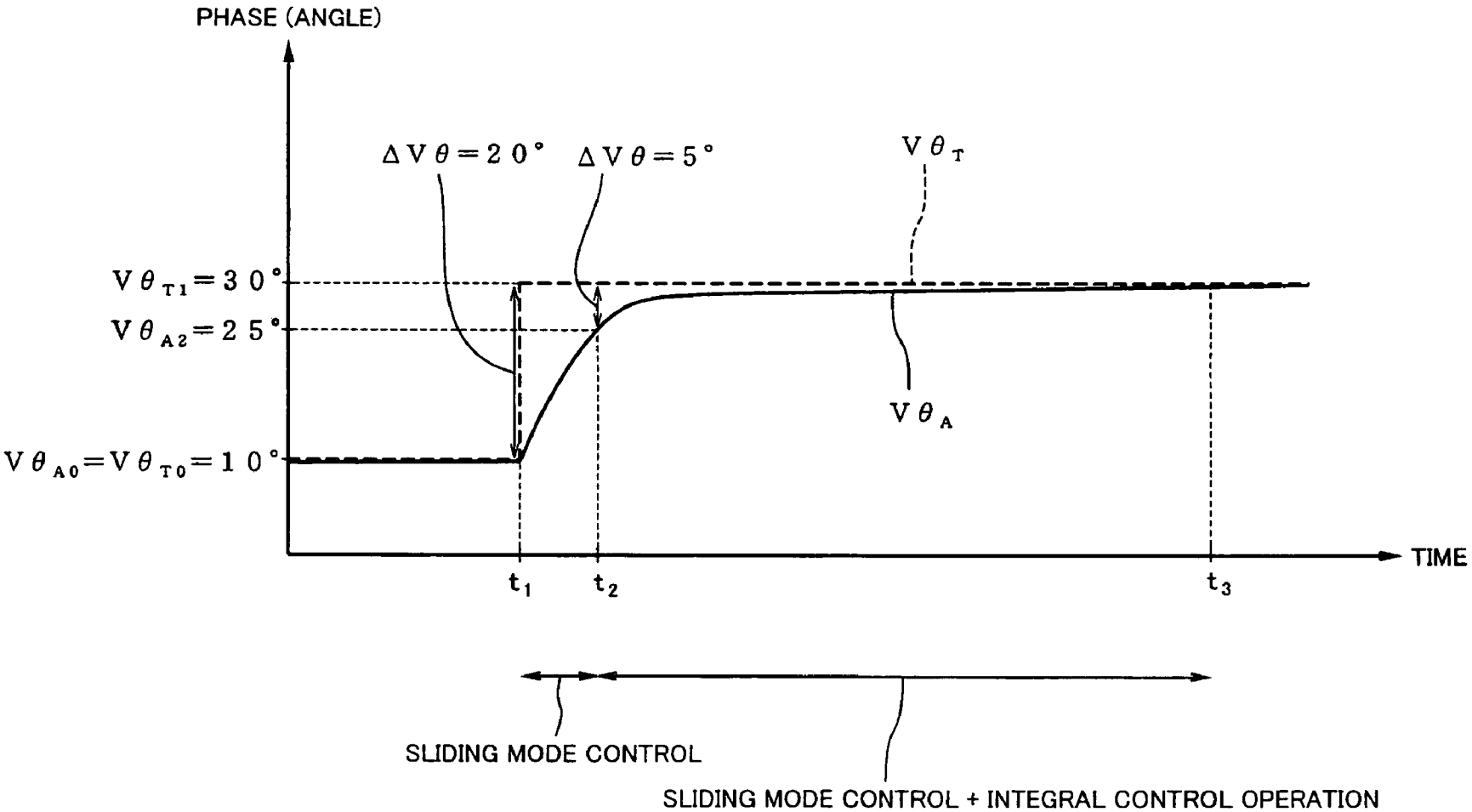
FIG. 8 is a graph showing an example of an operation of a rotor in the variable valve timing system which is phase-controlled by the controller of FIG. 6, in which a horizontal axis indicates time and a vertical axis indicates a phase (angle) of the rotor.

FIG. 8 is a graph showing an example of an operation of the rotor 29 in the variable valve timing system 25 which is phase-controlled by the controller 27, in which a horizontal axis indicates time and a vertical axis indicates a phase (angle) of the rotor 29. In FIG. 8, a solid line indicates an actually measured value VθA of the phase of the rotor 29 and a broken line indicates a target value VθT of the phase of the rotor 29.

In an example shown in FIG. 8, the actually measured value VθA0 of the phase of the rotor 29 substantially matches the target value VθT0 (here VθA0=VθT0=10 degrees), and thereafter a target value becomes VθT1 (here VθT1=30 degrees) at time t1. In this case, the deviation Δ V θ (=20 degrees) between the target value VθT1 and the actually measured value VθA0 at time ti is great, and its values falls outside the predetermined numeric value range Δ V θ range (−5 degrees to +5 degrees). In this state, Δ V θ which is input to the integral control calculator is zero, and the output of the integral control is kept unchanged, but only the output of the sliding mode control changes. For this reason, the actually measured value V θ A quickly becomes closer to the target value VθT1 while achieving high responsiveness and without occurrence of overshooting.

At time t2 (t2>t1), the deviation Δ V θ (=5 degrees) between the target value Vθ T1 and the actually measured value VθA2 falls within the numeric value range Δ V θ range, and the output of the sliding mode control and the output of the integral control both change. For this reason, the actually measured value converges with the target value VθT1 at time t3 while achieving high responsiveness, suppressing occurrence of overshooting and reducing the deviation.

Thereby, advantages of the high responsiveness and suppressing of occurrence of the overshooting, which are characteristics of the sliding mode control, are achieved, and the deviation resulting from the event that the actually measured value VθA has converged before reaching the target value VθT is reduced by the integral control.

As described above, the integral control operation (to be specific, the operation in the state where the deviation Δ V θ is not zero and the output of the integral control changes) is automatically executed with the sliding mode control according to the magnitude of the deviation Δ V θ. Therefore, a gain K1 associated with the sliding mode control and an integration gain K2 (see FIG. 6) associated with the integral control may be set to fixed values regardless of viscosity change of the hydraulic oil occurring according to temperature change or mechanical manufacturing errors, thus enabling simplified control.

In the control method of this embodiment, the numeric value range Δ V θ range with which it is determined whether or not the deviation Δ V θ should be integrated, is set to not less than −5 degrees and not more than +5 degrees, which are merely exemplary. The numeric value range ΔVθ range may be set to, for example, not less than −3 degrees and not more than +3 degrees, or otherwise absolute values of the upper limit value and the lower limit value therefore may be different from each other. It should be noted that, to execute the integral control operation in the state where the deviation ΔVθ is relatively small, it is necessary to set the absolute values of the upper limit value ΔVθ max and the lower limit value ΔVθ min of the numeric value range ΔVθ range larger than the value of the deviation which may result only when the sliding mode control is executed.

In this embodiment, the integration gain K2 is set to a relatively small value so that a time required for the deviation ΔVθ changes from 5 degrees at the start of the integral control operation to 1 degree is about 30 seconds. This makes it possible to surely bring the actually measured value VθA closer to the target value VθT while suppressing occurrence of the overshooting. By thus setting the integration gain K2 smaller, a time period (t2 to t3 in FIG. 8) when the deviation ΔVθ is input to the integral control calculator becomes short, and the value of the deviation ΔVθ in this time period is small, so that the output value of the integration section 52 becomes substantially equal to that of the deviation ΔVθ before being input, if the actually measured value VθA has converged the target value VθT quickly (e.g., in about one second). Thereby, a suitable state where the actually measured value VθA has converged the target value VθT quickly is substantially maintained, and the actually measured value VθA is expected to converge the target value VθT quickly even when the target value VθT changes thereafter.

The value of the integration gain K2 may be set according to the set value (the upper limit value ΔVθ max or the lower limit value ΔVθ min of the range ΔVθ range )of the deviation ΔVθ at the start of the integral control operation. For example, the value of the integration gain K2 may be changed in proportion as the set value of the absolute value of the upper limit value ΔVθ max or the lower limit value ΔVθ min.

Whereas the smoothing function (formula (3) in FIG. 6) is employed to inhibit chattering in the sliding mode control, other known functions capable of inhibiting chattering may alternatively be employed. Furthermore, whereas in the integral control, the deviation ΔVθ is integrated when it falls within in the range ΔVθ range, a value obtained by multiplying the deviation ΔVθ by a specified constant or a value obtained by adding a specified constant to the deviation ΔVθ may be integrated.

The construction of the variable valve timing system 25 and the construction of the control valve 26 to which the phase-control executed by the controller 27 is applied is not intended to be limited to the above. For example, the variable valve timing system 25 may be an electromagnetic system instead of the hydraulically-powered system.

Numerous modifications and alternative embodiments of the invention will be apparent to those skilled in the art in view of the foregoing description. Accordingly, the description is to be construed as illustrative only, and is provided for the purpose of teaching those killed in the art the best mode of carrying out the invention. The details of the structure and/or function maybe varied substantially without departing from the spirit of the invention and all modifications which come within the scope of the appended claims are reserved.

What is claimed is:

1. A method of controlling a variable valve timing system configured to change a position of a displacing member to change a rotational phase of a camshaft with respect to a crankshaft, comprising:

calculating, by a sliding mode control, a first control amount based on a deviation between a target value and an actually measured value of the position of the displacing member of the variable valve timing system;

calculating a second control amount by integrating the deviation as an input when the deviation falls within a predetermined numeric value range containing a zero value, or by integrating the zero value as the input when the deviation falls outside the predetermined numeric value range; and adding the first control amount and the second control amount to set a compensation control amount for compensating the position of the displacing member.

2. The method according to claim 1, wherein calculating the second control amount includes calculating the second control amount such that an integral gain is changed and set so as to be proportional to an absolute value of an upper limit value or a lower limit value of the predetetermined numeric value range when the absolute value is changed.

3. The method according to claim 1, wherein calculating the second control amount comprises integrating only the deviation when the deviation falls within the predetermined numeric value range.

4. The method according to claim 1, wherein calculating the second control amount includes integrating a value obtained by multiplying the deviation by a predetermined constant or by adding the predetermined constant to the deviation when the deviation falls within the predetermined numeric value range.

5. A controller for a variable valve timing system configured to change a position of a displacing member to change a rotational phase of a camshaft with respect to a crankshaft, comprising:

a deviation calculator configured to calculate a deviation between a target value and an actually measured value of the position of the displacing member of the variable valve timing system;

a deviation range determiner configured to determine whether or not the deviation falls within a predetermined numeric value range containing a zero value;

a sliding mode control calculator configured to, by a sliding mode control, calculate a first control amount based on the deviation;

an integral control calculator configured to calculate a second control amount by integrating an output from the deviation range determiner; and an adder configured to add the first control amount and the second control amount to set a compensation control amount for compensating the position of the displacing member;

wherein the deviation range determiner is configured to output the deviation to the integral control calculator when it is determined that the deviation falls within the numeric value range, and to output the zero value to the integral control calculator when it is determined that the deviation falls outside the numeric value range.

6. The controller for a variable valve timing system according to claim 5, wherein the numeric value range associated with the deviation which is used for determination in the deviation range determiner has an upper limit value of not more than plus 5 degrees and a lower limit value of not less than minus 5 degrees.

7. The controller according to claim 5, wherein the numeric value range associated with the deviation which is used for determination in the deviation range determiner has an upper limit value of not more than plus 3 degrees and a lower limit value of not less than minus 3 degrees.

8. The controller according to claim 5, wherein absolute values of an upper limit value and a lower limit value of the numeric value range associated with the deviation which is used for determination in the deviation range determiner are set larger than a value of a deviation which results when executing only the sliding mode control.

9. The controller according to claim 5, wherein the integral control calculator is configured to integrate only the deviation when the deviation falls within the predetermined numeric value range.

10. The controller according to claim 5, wherein the integral control calculator is configured to integrate a value obtained by multiplying the deviation by a predetermined constant or by adding the predetermined constant to the deviation when the deviation falls within the predetermined numeric value range.

11. A motorcycle comprising a controller for a variable valve timing system configured to change a position of a displacing member to change a rotational phase of a camshaft with respect to a crankshaft, the controller including:

a deviation calculator configured to calculate a deviation between a target value and an actually measured value of the position of the displacing member of the variable valve timing system;

a deviation range determiner configured to determine whether or not the deviation falls within a predetermined numeric value range containing a zero value;

a sliding mode control calculator configured to, by a sliding mode control, calculate a first control amount based on the deviation;

an integral control calculator configured to calculate a second control amount by integrating an output from the deviation range determiner; and an adder configured to add the first control amount and the second control amount to set a compensation control amount for compensating the position of the displacing member;

wherein the deviation range determiner is configured to output the deviation to the integral control calculator when it is determined that the deviation falls within the numeric value range, and to output the zero value to the integral control calculator when it is determined that the deviation falls outside the numeric value range.

12. The motorcycle according to claim 11, wherein the numeric value range associated with the deviation which is used for determination in the deviation range determiner has an upper limit value of not more than plus 5 degrees and a lower limit value of not less than minus 5 degrees.

13. A motorcycle comprising the controller according to claim 11, wherein the numeric value range associated with the deviation which is used for determination in the deviation range determiner has an upper limit value of not more than plus 3 degrees and a lower limit value of not less than minus 3 degrees.

14. A motorcycle comprising the controller according to claim 11, wherein absolute values of an upper limit value and a lower limit value of the numeric value range associated with the deviation which is used for determination in the deviation range determiner are set larger than a value of a deviation which results when executing only the sliding mode control.

15. A motorcycle comprising the controller according to claim 11, wherein the integral control calculator is configured to integrate only the deviation when the deviation falls within the predetermined numeric value range.

16. A motorcycle comprising the controller according to claim 11, wherein the integral control calculator is configured to integrate a value obtained by multiplying the deviation by a predetermined constant or by adding the predetermined constant to the deviation when the deviation falls within the predetermined numeric value range.

17. A method of controlling a variable valve timing system configured to change a position of a displacing member to change a rotational phase of a camshaft with respect to a crankshaft, comprising:

when a deviation between a target value of the position of the displacing member and an actually measured value of the position of the displacing member falls within a predetermined numeric value range containing a zero value, adding a first control amount calculated based on the deviation by a sliding mode control to a second control amount calculated by integrating the deviation as an input to set a compensation control amount for compensating the position of the displacing member; and when the deviation falls outside the predetermined numeric value range, setting the first control amount as the compensation control amount.

* * * * *